United States Patent [19]

Cook, Jr.

[11] 4,282,280

[45] Aug. 4, 1981

[54] HEAT INSULATION FOR TANKS AT CRYOGENIC AND HIGHER TEMPERATURES, USING STRUCTURAL HONEYCOMB WITH INTEGRAL HEAT RADIATION SHIELDS

[76] Inventor: William H. Cook, Jr., 875 SE. Shoreland Dr., Bellevue, Wash. 98004

[21] Appl. No.: 755,818

[22] Filed: Dec. 30, 1976

[51] Int. Cl.[3] ..... B31D 3/02

[52] U.S. Cl. ..... 428/116; 220/901; 428/119

[58] Field of Search ..... 428/73, 116–118, 428/119; 52/618; 220/901

[56] References Cited

U.S. PATENT DOCUMENTS

| | | | |
|---|---|---|---|
| 2,870,857 | 1/1959 | Goldstein | 428/116 X |
| 3,070,480 | 12/1962 | Breiner | 428/116 |
| 3,071,216 | 1/1963 | Jones et al. | 428/116 X |
| 3,365,897 | 1/1968 | Middleton et al. | 428/116 X |
| 3,669,816 | 6/1972 | Smith et al. | 428/458 X |
| 3,734,234 | 5/1973 | Wirt | 428/116 X |
| 3,895,152 | 7/1975 | Carlson et al. | 428/116 |
| 3,913,702 | 10/1975 | Wirt et al. | 428/118 X |
| 3,990,202 | 11/1976 | Becker | 52/173 R X |

*Primary Examiner*—Henry F. Epstein
*Attorney, Agent, or Firm*—Roy E. Mattern, Jr.

[57] ABSTRACT

Heat insulation for structures such as cryogenic tanks for example liquid natural gas tanks, often referred to as LNG tanks, is effective at cryogenic and higher temperatures up to the heat and structural limits of the honeycomb materials used which include integral heat radiation shields. The heat transfer is minimized with respect to conduction, by utilizing the minimum heat path possible within the honeycomb also essentially designed to take compressive loads, with respect to radiation, by placing multiple low emissivity heat shields spaced throughout the hexagonal cells, and in respect to convection, by replacing air with a low conductivity gas, or alternately creating a vacuum, to practically eliminate this convection mode of heat transfer.

3 Claims, 2 Drawing Figures

HEAT INSULATION FOR TANKS AT CRYOGENIC AND HIGHER TEMPERATURES, USING STRUCTURAL HONEYCOMB WITH INTEGRAL HEAT RADIATION SHIELDS

BACKGROUND OF INVENTION

Heat insulation is usually selected for a particular temperature range to be encountered. At very high temperatures, the insulation must be incombustible. At intermediate temperatures, as used in a building, the insulation is chosen to be adaptable to the type of structure. At low cryogenic temperatures maximum insulation effectiveness is desired, as it is more costly to remove heat than to replace it, as is the case at elevated temperatures. In the insulating of cryogenic structures the combination of the insulation and structure should be optimized. Although the insulation set forth hereinafter is primarily directed towards the cryogenic range, it may become economical for installations on structures, experiencing higher temperatures as fuel prices increase.

Large cryogenic tanks, such as for liquid natural gas tanks, often referred to as LNG tanks, have used a variety of insulations, including fiberglass, plastic foams, and balsa wood.

At the temperature of LNG, −165.5° C., the insulation requirements are less demanding than at the extremely low temperatures of liquid oxygen, nitrogen, helium, and hydrogen. For such low temperatures evacuated powders and multiple radiation shields spaced with low density fibers have been researched for use in small tanks for space vehicles. Conductivity of 1/100th of that of conventional foam insulations has been achieved. However application of this technology has not been applied to the large tanks used for transportation of liquid natural gas. Many large tank designs impose compressive loads on the insulation. Whereas a wall may have highly effective insulation between structural supports, the latter often constitute large heat leaks.

Considering the tank wall with its structure and insulation as a whole, the accepted figure of merit is the allowable compressive stress divided by the heat conductivity. If the insulation is capable of taking the loads by itself, the total heat transfer can be less than with a composite wall. Balsa will take the weight of a large LNG tank as used on many ships transporting liquid natural gas. However a balsa insulated LNG tank is usually stronger than required, and does not have particularly low conductivity. Plastic foams are often used on the sides of tanks where loads are lighter. However in respect to plastic foams, there is a minimum possible heat conductance. As the density of plastic foam insulation is decreased, the ability decreases to block radiative and convective heat, and the compressive strength may be lowered below practical utility. In contrast, in using the hereinafter described heat insulation, it is possible in designing LNG tanks to design separately for structural loads, and radiative and convective heat transfers.

SUMMARY OF INVENTION

Heat insulation for structures such as cryogenic tanks, for example liquid natural gas tanks, designated as LNG tanks, is effective at cryogenic and higher temperatures. This insulation is composed of structural honeycomb made from low conductivity material, with low emissivity radiation shields spaced along the hexagonal honeycomb cells. The structural honeycomb is used as the core in a sandwich construction with sealed faces. With this sealed sandwich construction, the air in the hexagonal honeycomb cells is replaced by a low conductivity gas, such as dichlorodifluromethane, $CCl_2F_2$, Freon 12, or for a lower heat transfer, a vacuum is created. However, the vacuum required should be within the capability of simple mechanical pumps. Low conductivity gas is easier to evacuate in part, and some lowering of the pressure is therefore practical. Also a gas is selected such that the residual gas, after moderate evacuation, will freeze on the inner wall of the inner tank separating the insulation from the cryogenic contents, thus eliminating heat transfer due to convection.

DESCRIPTION OF PREFERRED EMBODIMENT

Honeycomb in General

Figure 1:
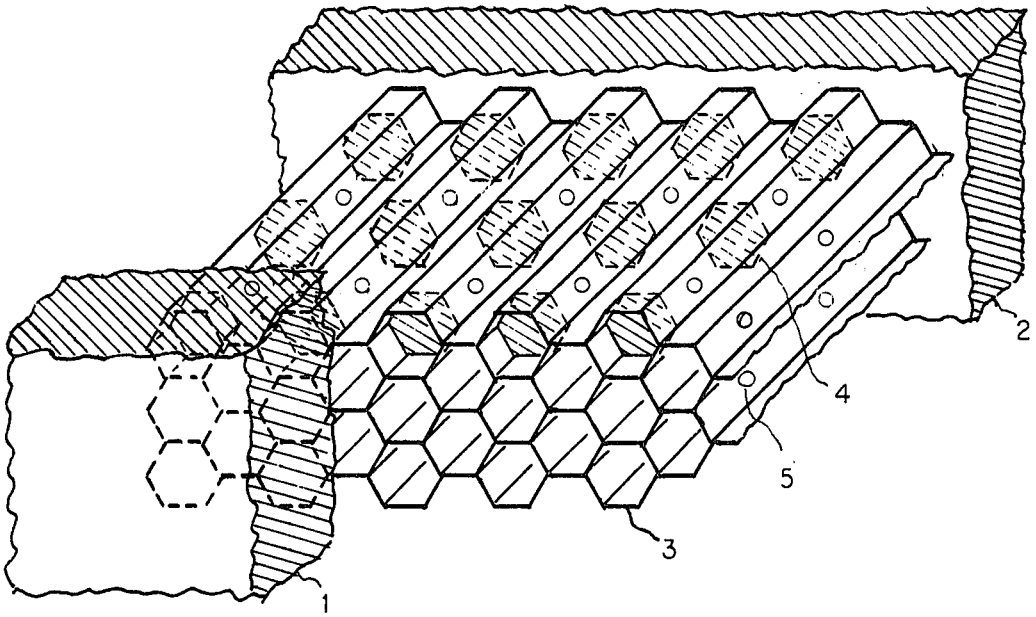
FIG. 1 is a cross section of the heat insulation within a LNG tank wall, comprising a structural sandwich with a hot wall, a cold wall, and a honeycomb core 3, having one or more radiation shields spaced in each hexagonal honeycomb cell, only shown, however in one of the honeycomb rows, and the basic honeycomb material is shown as being perforated with holes to permit leak detection by sampling the interior gas, and also to permit pressurization with a gas suitable for detection of a leak, which might be due to a flaw, damaged area, or joint.

Honeycomb has been used in a variety of structures and particularly in bonded sandwich construction. It provides shear resistance in bending and in torsion, compressive resistance normal to a wall, and local stiffening of the sandwich face sheets. The overall result of using honeycomb is the creation of a lightweight stiff structure. The basic sheet materials from which honeycomb is made are aluminum, impregnated fiberglass cloth, plastic laminates and/or kraft paper. These materials are selected according to strength and cost requirements of a final product. In compression along the axis of the hexagonal cell, the honeycomb fails by crushing, where the allowable load is independent of the depth of the honeycomb cell. The structural efficiency of honeycomb in compression is high, due to the continuous mutual support of the hexagonal cell elements. By selecting the core size and material thickness, the honeycomb is designed for a particular load. Kraft paper is preferred for honeycomb insulation because of its lower cost and low conductivity. The strength of kraft paper honeycomb is increased as required by the small impregnation of the paper with a plastic, such as phenolic.

In honeycomb heat insulation used on cryogenic tanks, the heat insulation must be more effective than that provided by a basic honeycomb. This greater insulation requirement requires blocking the radiation of heat, preferably with multiple heat radiation shields 4 of low emissivity material, such as polished aluminum or copper foil, or plastic films such as polyester coated with aluminum or copper. The film is preferred because of less thickness and lower conductivity. Multiple radiation shields 4 are desirable, up to the limit of the manufacturing process of honeycomb core 3 with the integral radiation shields 4. Such shields are spaced practically down to $\frac{1}{4}$ of the hexagonal cell width.

The remaining mode of heat transmission is by gas conduction and the multiple radiation shields are somewhat effective due to the insulating effect of the gas films on each surface of the radiation shields 4. However, it is preferable to replace the air in the honeycomb core 3 with a gas having lower conductivity. The common refrigerant, dichlorodifluromethane, $CCl_2F_2$, Freon 12, has $\frac{1}{3}$ the conductivity of air. Therefore the heat insulator structure is provided so air is flushed by first evacuating the air with a vacuum pump 10, and then filling with the gas. In the evacuation system, it is desirable to reflush in service in the case of any damage causing a leak. For this reason, it is desirable to have perforations 5, and a plenum chamber 6 in the overall tank so the heat insulation is cleaned periodically and the heat insulation is returned to its initial effectiveness.

A further reduction in gas convection is obtained by evacuation, with the vacuum pump 10 being used in the flushing process. Some of the gas will still be present, and a low conductivity gas is beneficial. With respect to air, the vacuum must approach a millionth of an atmosphere to be reasonably effective within the spacings of the cell walls of the honeycomb heat insulation. This degree of air vacuum is near the practical limit of simple mechanical pumps and therefore essentially impractical. However in respect to using a low conductivity gas, the vacuum needed to reduce the heat loss through convection to an insignificant level is well within the capability of simple mechanical pumps.

Also, gas residuals are often left after operation of a vacuum pump, so they will freeze at 16 on the inner cold wall 2 separating the honeycomb heat insulation 3 from the cryogenic tank contents. Some time after these heat insulated tanks are filled with liquid natural gas, the temperature will stabilize at the boiling point, −165.5° C. The freeze temperature of Freon 12 is −155° C., thus frost will form with the cold acting as a getter, using electron vacuum tube terminology.

Another advantage of having gas within this honeycomb heat insulation, rather than air, is that leak detection is facilitated. Freon 12 is easily detected because of its chlorine content. Equipment for this detection is commonly used with commercial and automotive air conditioners. A further advantage of using an inert dry gas in this honeycomb heat insulation is that corrosion of the aluminum radiation shields is prevented.

Figure 2:
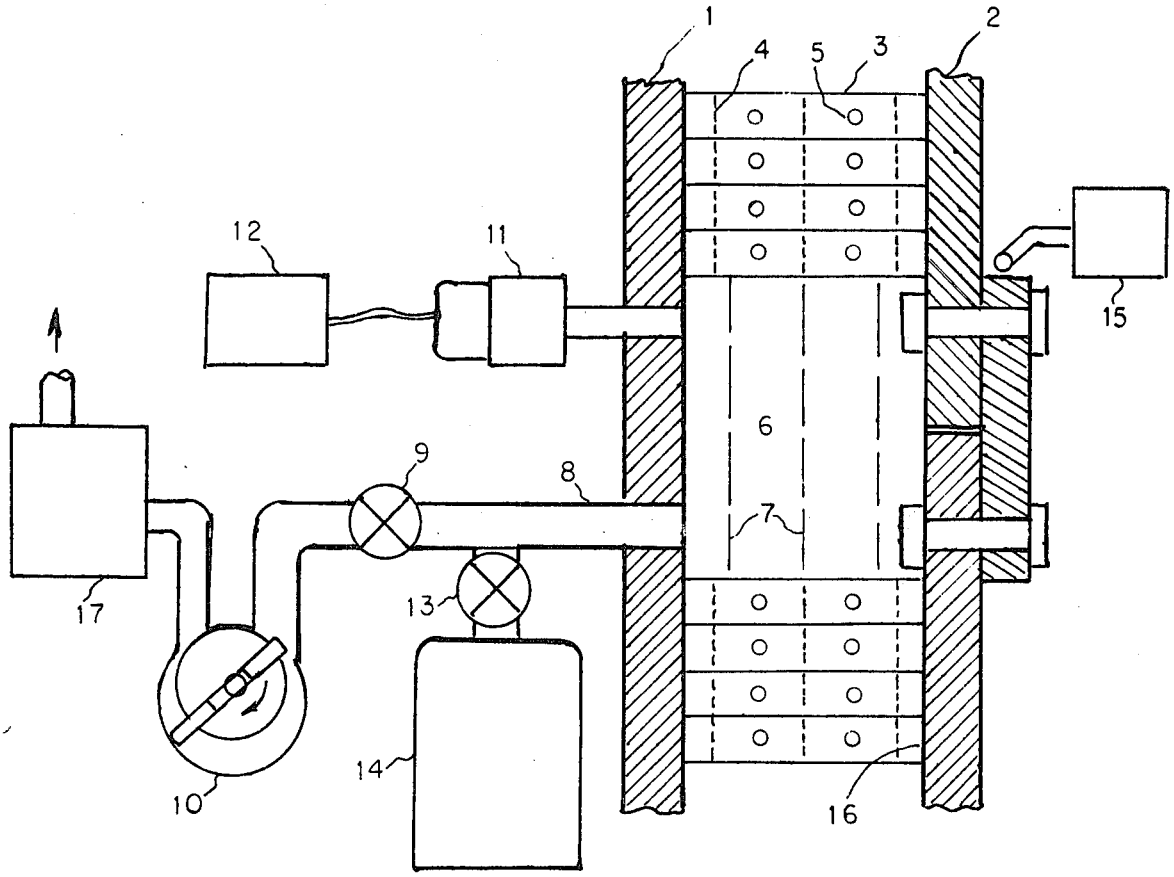
FIG. 2 is a cross section of the heat insulation of FIG. 1 wherein the overall structural honeycomb core sandwich wall has provisions for flushing with a low conductivity gas, and for evacuating some of the gas to minimize gas conductivity, using plenum chamber with perforated radiation shields connected to an outlet 8, a valve to be used to replace air and to be opened when a vacuum pump is operated until a pressure sensor of the thermocouple type, with indicator, shows the desired vacuum has been obtained, and also this valve may be closed and another valve may be opened, thereby connecting pressure tank containing low conductivity gas, such as Freon 12 $CCl_2F_2$ to a plenum and then this gas is supplied at a sufficient pressure to test for leaks with a leak detector, and following this testing, a vacuum pump may be operated to obtain sufficient vacuum to practically eliminate gas conduction, and when a low conductivity gas is used having a freeze point higher than the boiling point of the cryogenic tank contents, this residual low conductivity gas will frost on the cold wall, and moreover, during service, an alarm indicating a gas leak is provided by an indicator, whether the leak is air through the outside wall, or through an inside wall from the contents of the tank as determined by a gas analyzer.

When using this heat insulation honeycomb double wall tank construction, the lower limit in heat transfer is the conductivity through the honeycomb cell walls, and the two other modes of heat transfer, i.e., radiation and convection are reduced to insignificant levels. Equally important is constant capability of checking the insulation and being able to maintain it at its original effectiveness. This is illustrated in FIG. 2, wherein the overall honeycomb sandwich wall has provisions for flushing with a low conductivity gas, and for evacuating the gas to minimize gas conductivity. The plenum chamber 6 has perforated radiation shields 7 and is connected to an outlet 8. To replace the air, a first valve 9 is opened and a vacuum pump 10 is operated until the pressure sensor 11, often of the thermocouple type, having an indicator 12, shows the desired vacuum has been obtained. The first valve 9 is then closed and the second 13 is opened, thereby connecting pressure tank 14 containing low conductivity gas, such as Freon 12, $CCl_2F_2$, to the plenum 6. Sufficient pressure is then applied to test for leaks using the detector 15. Following this testing, the vacuum pump 10 may be operated to obtain sufficient vacuum to practically eliminate gas conduction. When so operated and a low conductivity gas is used having a freeze point higher than the boiling point of the cryogenic tank contents, the residual gas will frost at 16 on the cold wall 2. During service an alarm for a leak is provided by an indicator 12. Whether the leak is air through the outside wall, or is the contents of the tank, through the inside wall, the leak is determined by the gas analyzer 17.

I claim:

1. Heat insulation for tanks at cryogenic and higher temperatures, using structural honeycomb with integral heat radiation shields, comprising structural honeycomb with multiple low emissivity radiation shields, located within each cell of the honeycomb, each radiation shield filling a transverse cross section of the cell, and separated from adjacent heat radiation shields and also separated from inner and outer walls adjacent the honeycomb open spaces.

2. Heat insulation, as claimed in claim 1, wherein the structural honeycomb has openings between the heat radiation shields and with air replaced by a low conductivity gas using these openings in the honeycomb.

3. Heat insulation, as claimed in claim 2, wherein a vacuum is used in combination with the low conductivity gas and this gas has a freeze temperature above the temperature of the cryogenic tank contents and this insulation is more effective, because of the vacuum, in reducing the heat transfer, otherwise caused by gas conduction, to an insignificant level in relation to the conduction through the solid walls of the honeycomb.

* * * * *